United States Patent [19]

Houle et al.

[11] Patent Number: 5,023,928

[45] Date of Patent: Jun. 11, 1991

[54] APPARATUS FOR REDUCING THE CURRENT DRAIN ON THE SACRIFICIAL ANODE IN A WATER HEATER

[75] Inventors: Timothy H. Houle, Wauwatosa; Daher T. Wardy, Milwaukee, both of Wis.

[73] Assignee: A. O. Smith corporation, Milwaukee, Wis.

[21] Appl. No.: 400,364

[22] Filed: Aug. 30, 1989

[51] Int. Cl.[5] ..... F24H 1/20; H05B 3/78

[52] U.S. Cl. ..... 392/457; 204/196; 204/197

[58] Field of Search ..... 219/316, 318, 322, 335, 219/336; 204/196, 197; 392/451, 453, 455, 457

[56] References Cited

U.S. PATENT DOCUMENTS

| | | | |
|---|---|---|---|
| 3,056,879 | 10/1962 | Fischer | 219/318 |
| 3,694,626 | 9/1972 | Harnden Jr. | 219/322 |
| 3,860,787 | 1/1975 | Strobach | 219/336 |
| 4,848,616 | 7/1989 | Nozaki | 219/316 |

*Primary Examiner*—Bruce A. Reynolds
*Assistant Examiner*—John A. Jeffery
*Attorney, Agent, or Firm*—Andrus, Sceales, Starke & Sawall

[57] ABSTRACT

The sacrificial anode in an electrically-heated water heater is protected against excessive current drain and premature dissolution resulting from the cathodic effect of the metal jacket on the heating element by a protective device which provides an effective insulating separation between the jacket and the tank wall to eliminate current flow to the jacket from the protective anode, and a non-linear semiconductor between the jacket and the tank having a breakover voltage allowing it to become conducting at hazardous overvoltage levels. In one embodiment, the heating element jacket is separately insulated from the tank wall and a discrete semiconductor device is separately attached between the jacket and the tank to maintain the insulated condition unless an overvoltage condition occurs and to then become conducting to shunt to overvoltage current to the grounded tank wall. In another embodiment, a voltage breakdown material may be applied directly as the insulating layer between the heating element jacket and the tank wall. The material remains an insulator until it is caused to breakdown at an appropriate overvoltage level, where upon it becomes irreversibly conductive.

7 Claims, 2 Drawing Sheets

APPARATUS FOR REDUCING THE CURRENT DRAIN ON THE SACRIFICIAL ANODE IN A WATER HEATER

BACKGROUND OF THE INVENTION

The present invention relates to a method and apparatus for reducing the rate of loss of a sacrificial protective anode in a water storage tank as a result of undesirable cathodic reactions and, more particularly, to a method and apparatus for reducing the protective anode current and dissolution of the anode as a result of the cathodic effect of the metal-jacketed heating element in an electric water heater.

A typical water heater includes a storage tank made of ferrous metal and lined internally with a glass-like porcelain enamel to protect the metal from corrosion. Nevertheless, the protective lining may have imperfections or, of necessity, not entirely cover the ferrous metal interior, such that an electrolytic corrosion cell may be established as a result of dissolved solids in the stored water leading to corrosion of the exposed ferrous metal and substantial reduced service life of the water heater. The water in the tank may be heated by gas or electric power and it is well known that uninhibited corrosion is substantially enhanced in the presence of hot water.

It is also well known in the art to utilize a sacrificial anode within the tank to protect against corrosion of the ferrous metal tank interior. The sacrificial anode is selected from a material which is electronegative with respect to the tank and by galvanic reaction maintains the tank metal in a passive and non-corrosive state. Alternatively, a protective anode may be powered by providing a source of electrical potential to establish a positive voltage differential between the anode and the tank.

In an electric water heater, an electric heating element is attached to the tank wall and extends into the tank to provide direct heating of the water. The heating element typically includes an internal high resistance heating element wire surrounded by a suitable insulating material and enclosed in a metal jacket such that the jacket is completely insulated from the internal heating element. Power for the heating element is typically supplied from a conventional 110 or 220 volt AC source. When the exterior metal jacket of the heating element is immersed in the water in the tank, it imposes an electrical load on the protective anode in the same manner as the exposed ferrous metal interior of the tank. As a result, the protective anode current is increased and the anode is subject to more rapid dissolution. Therefore, the life of the anode and thus the water heater are substantially shortened. In a typical electric water heater, less than half the protective anode current is needed to protect the tank interior with the remaining current resulting from the additional load imposed by the heating element jacket. However, the heating element jacket typically comprises or is plated with a metal more electropositive than the tank metal and thus does not require the same level of cathodic protection. In addition, heating elements are relatively inexpensive and easy to replace. In addition to the large current draw imposed on the protective anode by the heating element jacket, the heating element also creates a "shadowing" effect on any exposed interior portions of the tank in the vicinity of the heating element. As a result, anode current which might otherwise protect these areas of the tank flows instead to the heating element jacket and leaves the metal tank wall portions in this area with inadequate protection.

It would be most desirable, therefore, to reduce the electrical load which the heating element jacket imposes on the protective anode in an electric hot water heater. One way would be to simply electrically insulate the heating element jacket from the tank. However, the metal tank is typically grounded and, for safety reasons, a conductive path must be provided between the heating element jacket and the tank to provide a shunt for an overvoltage condition, such as would occur if damage to the heating element resulted in a short between the interior element wire and the metal jacket. Another solution to the problem would be to provide a resistance connection between the heating element jacket and the tank wall to reduce the anode current. However, to effectively reduce the anode current draw, the resistance would be too great to provide an adequate ground path in the event of an overload condition. It would also be possible to establish an impressed voltage differential between the heating element jacket and the tank wall, with the former maintained positive with respect to the latter. However, with the heating element jacket otherwise electrically insulated from the tank to allow maintenance of the potential difference, a conductive path for an overvoltage condition would not be available.

Thus, there remains a need for a practical solution to the excessive current draw and shadowing effect which an electric heating element jacket causes in an anodically protected electric water heater.

SUMMARY OF THE INVENTION

In accordance with the present invention the increase in protective anode current and the shadowing effect created by the metal jacket of an electric heating element in a water heater are eliminated or substantially reduced with an apparatus which electrically insulates the metal jacket from the tank wall and provides a non-linear resistance path between the jacket and the tank which prevents current flow at low voltage levels but allows current flow resulting from a high overvoltage condition. The non-linear resistance device comprises a semiconductor means which may be selected to be non-conducting below a low voltage level in a selected range. Various types of semiconductor devices may be utilized, such as a diode, zener diode, or metal oxide varistor.

In another embodiment, the semiconductive device comprises a voltage breakdown material which may be used to additionally provide the insulating separation between the metal jacket and the tank wall. The voltage breakdown material is non-conducting and insulating below its breakdown voltage which may, for example, range between 30 and 100 volts. The material is preferably applied in a thin layer at the insulating separation between the metal jacket and the tank wall. Preferably, the breakdown material layer is applied at the interface between the legs of the jacket in a conventional heating element and the conductive mounting plug which supports the jacket. In this manner, a heating element employing the protective apparatus of the present invention can be incorporated directly into a conventional mounting assembly for direct threaded connection to a conventional mounting spud attached to the tank wall.

DETAILED DESCRIPTION OF THE PREFERRED EMBODIMENT

Figure 1:
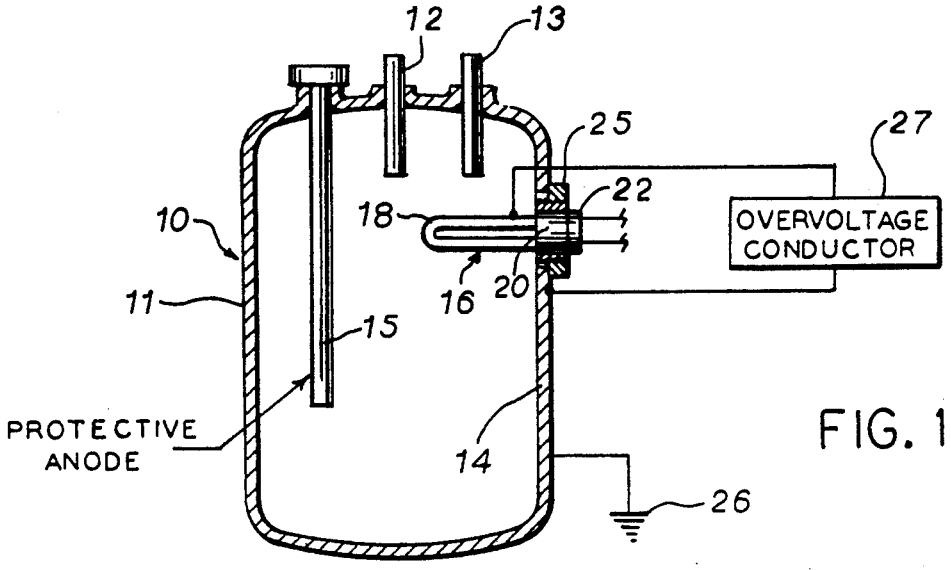
FIG. 1 is a schematic representation of an electrically heated water heater in which the tank is provided with a protective anode and the heating element is provided with the protective non-linear resistance device of the present invention.
Figure 2:
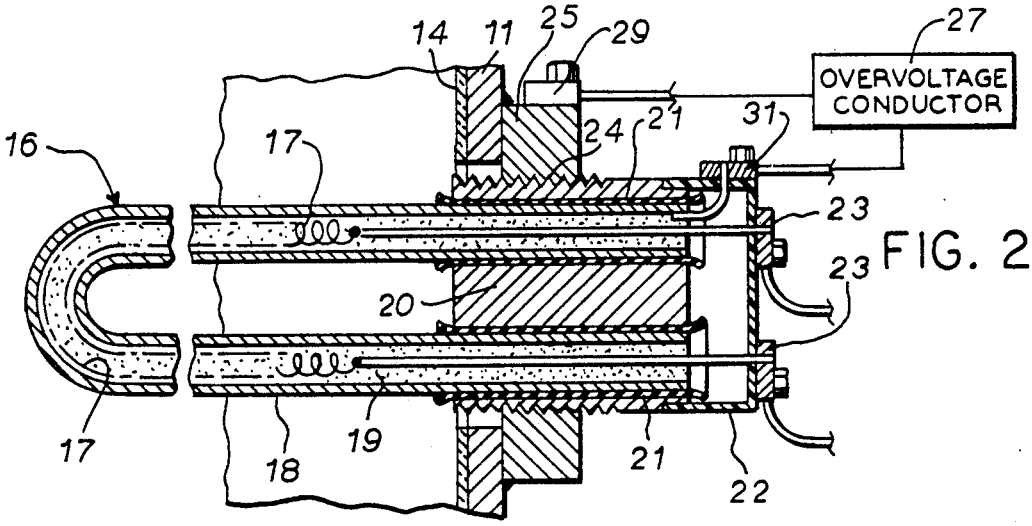
FIG. 2 is an enlarged detail of a section through the tank wall of a water heater showing the heating element and tank connected to the protective bias device of the present invention.

Referring first to FIGS. 1 and 2, an electric water heater 10 includes a tank 11 made of a ferrous metal, i.e. steel, in which water is stored and heated. The tank includes a cold water inlet 12 and heated water outlet 13, both of a conventional construction. To provide corrosion protection to the interior of the tank, a glass or ceramic lining 14 covers substantially the entire interior of the tank. However, as is well known in the art, minute cracks or other imperfections may develop in the lining 14 or certain portions of the metal tank may not be covered by the lining 14, such that the metal is exposed to the water in the tank. As a result of the usual dissolved minerals and other solids in the water, electrolytic corrosion of the exposed tank will occur absent appropriate protection.

A protective anode 15 is mounted on and extends into the interior of the tank 11 to provide corrosion protection in a known manner. The anode 15 may be of a passive types, as shown, wherein it is constructed of a metal more electronegative than the tank metal to establish an electrochemical couple with the anode 15 acting as a sacrificial electrode to protect the interior tank wall. Alternately, the anode 15 could be externally powered to provide a positive potential difference between the anode and the tank wall without regard to the type of metal from which the anode is constructed. In either case, oxidative dissolution of he anode over time protects the exposed interior metal portions of the tank.

In the electric water heater 10, an electric heating element 16 is mounted in the wall of the tank 11 and extends into the tank interior to contact and heat the water stored therein. In accordance with conventional construction, the heating element 16 includes a high resistance element wire 17 disposed within a U-shaped metal jacket 18 and insulated therefrom by an interior layer of a granular refractory material 19, such as magnesium oxide. The opposite ends of the heating element wire 17 are typically attached to a source of alternating current at 220 or 110 volts. The heating element jacket 18 is typically made of copper and may additionally be tin or zinc plated.

The outer end of the heating element 16 includes a mounting plug 20 for supporting the heating element jacket and attaching the heating element to the tank wall 11. The legs of the heating element jacket extend through the mounting plug 20 and are electrically insulated from the conductive metal plug 20 by insulating sleeves 21. The ends of the heating element wire 17 also extend through the mounting plug to an insulating terminal mount 22 on the outside thereof for connection to a pair of terminals 23 from the AC power source. The mounting plug 20 is provided with exterior threads 24 for attachment to an internally threaded spud or mounting ring 25 which is welded or otherwise attached directly to the tank wall 11. It should be pointed out that, in conventional construction, the insulating sleeves 21 between the heating element jacket 18 and the mounting plug 20 are eliminated, such that there is a direct conductive connection between the jacket and the tank wall. In addition, the tank wall is typically grounded, as at 26. Should damage to or a defect in the heating element result in the wire 17 coming in direct contact with the jacket 18, the prior art construction allows the high voltage current imposed on the heating element jacket to be shunted directly to ground via the conductive connection to the tank wall.

The exposed metal jacket 18 which extends into the water in the tank 11 provides a substantial bare metal surface area which, if conductively connected to the tank, induces a substantially higher current in the protective anode 15 resulting in more rapid dissolution thereof As previously indicated, merely insulating the element jacket 18 from the tank wall, as with the insulating sleeves 21, would substantially reduce or eliminate the current drain by the heating element on the anode. However, the conductive path between the heating element and ground in the event of an overvoltage condition would be lost.

In one embodiment of the invention, as shown generally in FIG. 1, an overvoltage semiconductor device 27 is connected directly between the jacket 18 and the tank wall 11. At low voltage levels, the semiconductor device 27 is non-conducting and thereby maintains the insulative separation between the jacket and the tank wall provided by the insulating sleeves 21. However, should an overvoltage condition occur as a result, for example, of a short between the heating element wire 17 and the jacket 18, the non-linear resistance characteristics of the semiconductor device 27 allow current to flow therethrough directly to ground 26. The semiconductor device may be chosen to retain its insulating properties and be nonconducting below any desired voltage in a selected range, such as 18 to 100 volts. In this manner, an overvoltage condition in a heating element which is powered by the usual AC source will cause the resulting current to be shunted directly through the device to ground. Referring also to FIG. 2, the overvoltage conductor 27 has one lead attached to a tank terminal 29 providing direct conductive connection to the tank wall 11 and the other lead attached to a jacket terminal 31 conductively connected to the jacket 18.

Figure 3:
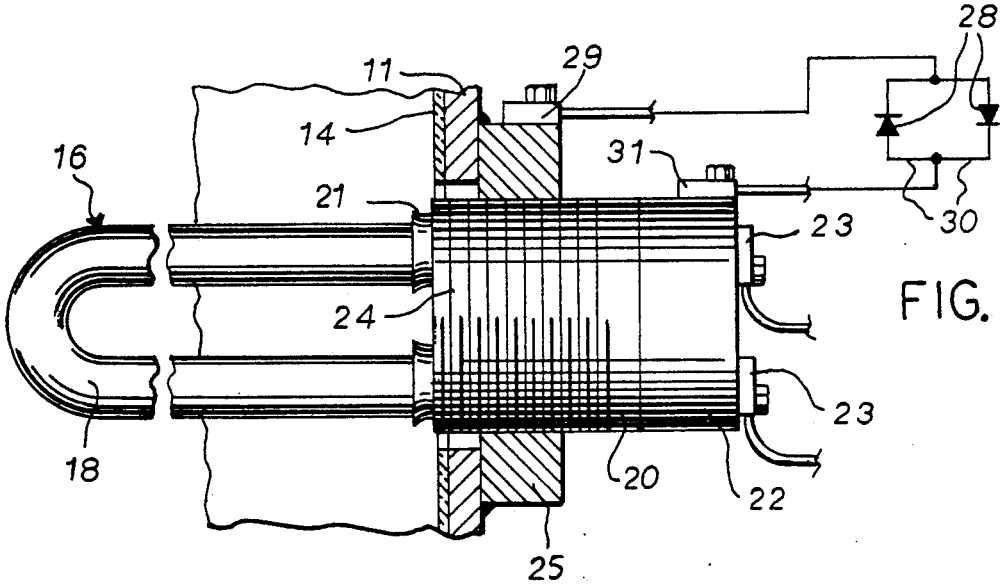
FIG. 3 is a view similar to FIG. 2 showing one specific semiconductive device useful in the present invention.
Figure 4:
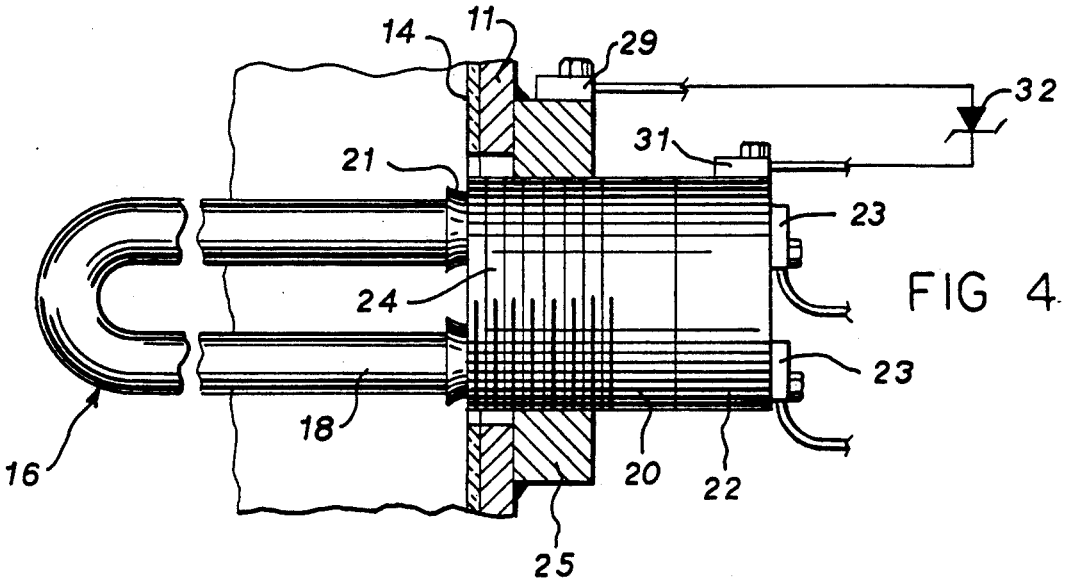
FIG. 4 is a view similar to FIG. 3 showing another semiconductive device.
Figure 5:
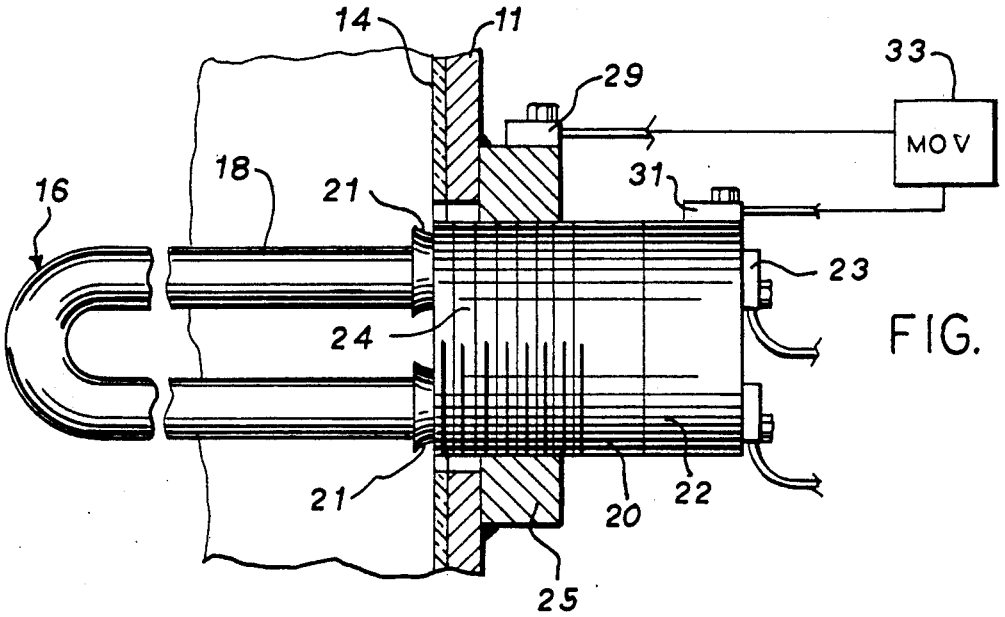
FIG. 5 is a view similar to FIGS. 3 and 4 showing yet another semiconductive device useful in practicing the present invention.

FIGS. 3–5 show various specific semiconductor devices which may be utilized as low voltage insulators and overvoltage conductors in accordance with this embodiment of the invention In each case, they are similarly connected directly between the heating element jacket and the tank wall. In FIG. 3, a pair of conventional diodes 28 are oppositely disposed and connected in parallel branches 30 to allow overvoltage current flow in either direction.

FIG. 4 a zener diode 32 is similarly connected to allow an overvoltage current flow from the heating element jacket 18 to the tank wall 11. In FIG. 5, a metal oxide varistor 33 is similarly connected between the jacket and the tank wall and its breakover voltage selected to allow it to conduct at the selected overvoltage level. It is contemplated that other semiconductor devices may also be used which have similar non-linear resistance characteristics such that they may retain the necessary insulating separation up to a selected overvoltage level.

Figure 6:
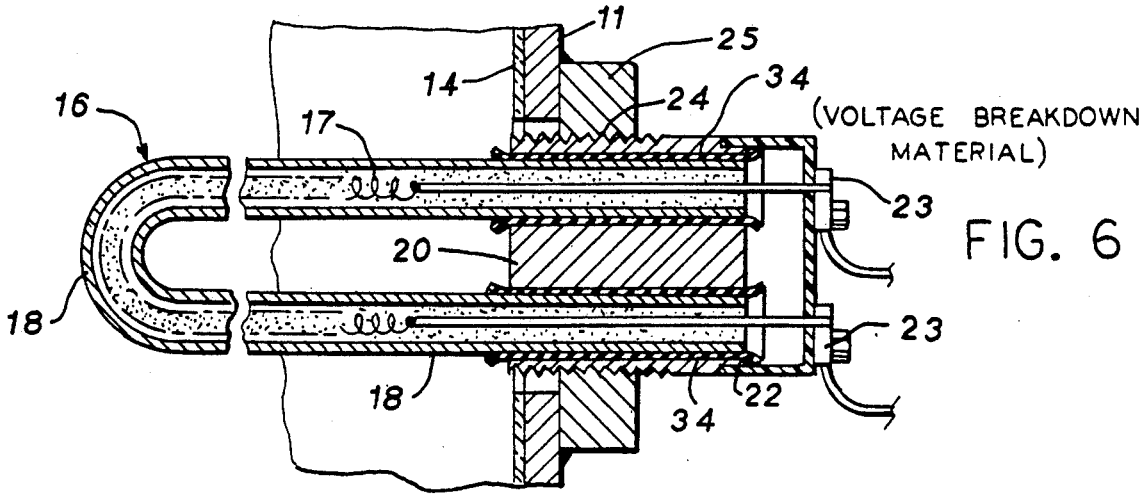
FIG. 6 is an enlarged detail of a section through the tank wall of a water heater showing the heating element incorporating an alternate embodiment of the invention.

Referring also to FIG. 6, in another embodiment of the present invention, the semiconductor device comprises a voltage breakdown material 34 which may be substituted directly for the insulating sleeves 21 and provide the non-linear resistance function previously described. Like the discrete semiconductor devices previously described, the breakdown material 34 acts as an insulator up to the breakdown voltage thereof and thereafter as a conductor. However, the nature of this material is such that once the overvoltage level has been reached and the material becomes conductive, it remains so even though the applied voltage may drop below its initial breakdown level. This is believed to be significant, particularly in electric water heater applications, where it provides a fail-safe overvoltage shunt to ground.

Compositions similar to that used in a metal oxide varistor may be used as the breakdown material. It is contemplated that the breakdown material 34 could be provided in powdered form and mixed with a suitable adhesive and hardener, such that it could be applied as a solid film or as a liquid that cures in place after application by any convenient means. It is also significant that the use of the breakdown material obviates the need to utilize a separate discrete component and make the required additional connections between the jacket and tank wall.

Various modes of carrying out the present invention are contemplated as being within the scope of the following claims particularly pointing out and distinctly claiming the subject matter which is regarded as the invention.

We claim:

1. In an electrically-heated water supply including a metal tank for heating and storing water, a protective anode within the tank to reduce electrolytic corrosion of exposed interior portions of the tank wall, and an electric heating element enclosed in a metal jacket mounted in the tank wall and extending into the tank, an apparatus for reducing the anode current as a result of the cathodic effect of the heating element jacket comprising:

insulating means for providing an electrically insulated separation between the metal jacket and the tank wall; and voltage responsive semiconductor means connecting the jacket and the tank for preventing current flow at low voltage below the range of 18 to 100 volts and allowing bidirectional current flow at higher overvoltage above said range.

2. The apparatus as set forth in claim 1 wherein said semiconductor device comprises a voltage breakdown material.

3. The apparatus as set forth in claim 2 wherein said voltage breakdown material comprises said insulating means.

4. The apparatus as set forth in claim 3 wherein said voltage breakdown material is nonconducting below a breakdown voltage in the range of 30 to 100 volts.

5. The apparatus as set forth in claim 3 wherein said breakdown material comprises a thin layer disposed in the insulated separation between the metal jacket and the tank wall.

6. The apparatus as set forth in claim 5 wherein said heating element includes a conductive mounting plug for attachment to the tank wall, said metal jacket is U-shaped and includes a pair of legs supported by said mounting plug, and wherein said breakdown material forms the interface between the legs of the jacket and said mounting plug.

7. The apparatus as set forth in claim 6 including a mounting spud conductively attached to the tank wall, defining an opening therein for said heating element and providing a threaded connection for the mounting plug.

* * * * *

UNITED STATES PATENT AND TRADEMARK OFFICE

CERTIFICATE OF CORRECTION

PATENT NO. : 5,023,928

DATED : 6-11-91

INVENTOR(S) : Timothy H. Houle et al

It is certified that error appears in the above-identified patent and that said Letters Patent is hereby corrected as shown below:

Colunm 6, line 43, the following claims should be added:

-- 8. The apparatus as set forth in claim 1 wherein said semiconductor means comprises a pair of parallel connected oppositely disposed diodes.

9. The apparatus as set forth in claim 1 wherein said semiconductor device comprises a zener diode.

10. The apparatus as set forth in claim 1 wherein said semiconductor device comprises a metal oxide varistor. --.

On the title page, after the Abstract "7 Claims" should read --10 Claims--.

Signed and Sealed this

Twentieth Day of October, 1992

*Attest:*

DOUGLAS B. COMER

*Attesting Officer*

*Acting Commissioner of Patents and Trademarks*